US010135171B2

(12) United States Patent
Noro et al.

(10) Patent No.: US 10,135,171 B2
(45) Date of Patent: Nov. 20, 2018

(54) CONNECTOR

(71) Applicant: Sumitomo Wiring Systems, Ltd., Yokkaichi, Mie (JP)

(72) Inventors: Yutaka Noro, Mie (JP); Yuki Kondo, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/743,483

(22) PCT Filed: Jun. 27, 2016

(86) PCT No.: PCT/JP2016/068939

§ 371 (c)(1),
(2) Date: Jan. 10, 2018

(87) PCT Pub. No.: WO2017/010269

PCT Pub. Date: Jan. 19, 2017

(65) Prior Publication Data

US 2018/0205169 A1 Jul. 19, 2018

(30) Foreign Application Priority Data

Jul. 16, 2015 (JP) ..... 2015-142178

(51) Int. Cl.

| | |
|---|---|
| ***H01R 13/62*** | (2006.01) |
| ***H01R 13/436*** | (2006.01) |
| ***H01R 13/502*** | (2006.01) |
| ***H01R 13/424*** | (2006.01) |
| ***H01R 43/18*** | (2006.01) |
| *H01R 13/703* | (2006.01) |

(52) U.S. Cl.

CPC ..... *H01R 13/4368* (2013.01); *H01R 13/424* (2013.01); *H01R 13/5025* (2013.01); *H01R 43/18* (2013.01); *H01R 13/7031* (2013.01)

(58) Field of Classification Search

CPC ..... H01R 13/4368; H01R 43/18; H01R 13/4362; H01R 13/506; H01R 13/62944;

(Continued)

(56) References Cited

U.S. PATENT DOCUMENTS 5,104,253 A * 4/1992 Zielinski ..... H01R 13/6272 403/329
5,484,301 A * 1/1996 Koumatsu ..... H01R 13/5221 439/271

(Continued)

FOREIGN PATENT DOCUMENTS

JP 10-162925 6/1998
JP 2002-231367 8/2002

(Continued)

OTHER PUBLICATIONS

International Search Report dated Sep. 27, 2016.
European Search Report dated May 7, 2018.

*Primary Examiner* — Jean F Duverne
(74) *Attorney, Agent, or Firm* — Gerald E. Hespos; Michael J. Porco; Matthew T. Hespos

(57) ABSTRACT

It is aimed to provide a connector capable of preventing the breakage of side walls (18). A housing (10) includes a mounting hole (17) into which a retainer (60) is mounted, and side walls (18) for closing the mounting hole (17) from opposite sides. The side wall (18) is provided with lock receiving portions (22). Lock protrusions (68) configured to slide while deflecting the side walls (18) in the process of inserting the retainer (60) into the mounting hole (17) and release the side walls (18) from a deflected state and enter the lock receiving portions (22) when reaching positions corresponding to the lock receiving portions (22) are provided on outer surfaces of the retainer (60). Both end corner parts of the lock protrusion (68) in a sliding width direction (Y) perpendicular to a sliding direction on the side wall (18) are chamfered.

10 Claims, 11 Drawing Sheets

(58) Field of Classification Search
CPC ..... H01R 13/6272; H01R 13/5219; H01R 13/6221; H01R 13/7031; H01R 13/424; H01R 13/5025
USPC ..... 439/686
See application file for complete search history.

(56) References Cited

U.S. PATENT DOCUMENTS 6,368,132 B1 * 4/2002 Okayasu ..... H01R 13/5219 439/273
8,827,737 B2 * 9/2014 Makino ..... H01R 13/506 439/357
9,472,884 B2 * 10/2016 Kutsuna ..... H01R 13/4362
2006/0194469 A1 * 8/2006 Miyakawa ..... H01R 13/6272 439/357
2006/0205262 A1 * 9/2006 Buchter ..... H01R 13/62944 439/358
2009/0111318 A1 4/2009 Horiuchi
2009/0298353 A1 12/2009 Kojima

FOREIGN PATENT DOCUMENTS

JP 1010040366 A 2/2010
JP 4941229 3/2012
JP 2014-183003 9/2014

* cited by examiner

CONNECTOR

BACKGROUND

Field of the Invention

The invention relates to a connector.

Description of the Related Art

Japanese Unexamined Patent Publication No. 2002-231367 discloses a connector that includes a housing having a terminal accommodating portion (cavity) capable of accommodating a female terminal (terminal fitting) and a locking member (retainer) to be inserted into a locking member accommodation hole (mounting hole) of the housing. The locking member has a doubly locking portion (retaining portion) for locking the female terminal in the terminal accommodating portion in a retained state. Engaging holes (lock receiving portions) are provided in both side surfaces of the housing and communicate with the locking member accommodating hole. Engaging projections (locks) are provided on both side surfaces of the locking member and are insertable into the engaging holes (lock receiving portions) for locking.

The locking member accommodation hole communicates with the terminal accommodating portion and has a rectangular cross-section that is open in the upper surface of the housing. The housing includes thin side walls for closing the locking member accommodation hole from opposite sides. The side walls are deflected and deformed by the engaging projections sliding on the inner surfaces thereof in the process of mounting the locking member into the locking member accommodation hole, and the deflected state is released and the engaging projections are inserted into the engaging hole as the engaging projections reach positions corresponding to the engaging holes.

The above-described engaging projection has right-angled corner parts in a sliding width direction perpendicular to a sliding direction. Thus, as shown as a reference in FIG. 12, the sliding of an engaging projection 2 on a side wall 3 causes the side wall 3 to be pulled strongly by both end corner parts 4 of the engaging projection 2 and, in a worst case scenario, the side wall 3 may be deflected beyond a resiliency limit to be broken.

The invention was completed based on the above situation and aims to provide a connector capable of preventing the breakage of side walls.

SUMMARY

The invention is directed to a connector with a housing including a cavity into which a terminal fitting is insertable, and a mounting hole communicates with the cavity. Deflectable side walls close the mounting hole from opposite sides. Lock receiving portions are provided on the side walls. A retainer can be inserted into the mounting hole/. The retainer includes a retaining portion for locking the terminal fitting in the cavity and lock protrusions that are lockable to the housing by coming into contact with the lock receiving portions. The lock protrusions are slidable on the side walls on outer sides. The lock protrusions have end corner parts in a sliding width direction perpendicular to a sliding direction on the side wall. The end corner parts are chamfered. The chamfered end corner parts of the lock protrusion in the sliding width direction suppress having the side wall be deflected, deformed and strongly pulled by the lock protrusion, and thus the breakage of the side wall can be prevented when the lock protrusion slides.

A tip corner part of the lock protrusion in the sliding direction on the side wall is chamfered. According to this configuration, the side wall is less likely to be pulled strongly by the lock protrusion and the breakage of the side wall can be prevented more reliably when the lock protrusion slides while deflecting the side wall.

A dimension of a base of the lock protrusion in the sliding width direction is equal to or larger than half the opening dimension of the mounting hole in the sliding width direction. According to this configuration, since the side wall is easily broken by being pulled by the lock protrusion, it provides a large advantage that the both end corner parts of the lock protrusion in the sliding width direction are chamfered.

A projecting end of the lock protrusion is retracted from an outer surface of the side wall with the lock protrusion inserted in the lock receiving portion. According to this configuration, interference of external matter with the projecting end of the lock protrusion can be avoided with the lock protrusion inserted in the lock receiving portion.

The retainer is movable, with respect to the housing, to a partial locking, where the retaining portion is retracted from the cavity, and a full locking position, where the retaining portion is inserted into the cavity to retain the terminal fitting. The retainer is provided with full locking protrusions separately from the lock protrusions. The lock protrusions lock the lock receiving portions to restrict the separation of the retainer from the housing at the partial locking position, and the full locking protrusions lock full locking receiving portions of the housing to restrict a returning movement of the retainer from the full locking position to the partial locking position. The full locking protrusion is arranged in front of the lock protrusion in the sliding direction of the lock protrusion on the side wall. According to this configuration, a range in which the lock protrusion slides on the side wall can be reduced and the breakage of the side wall can be prevented even more reliably.

A projecting dimension of the full locking protrusion is smaller than that of the lock protrusion. According to this configuration, sliding resistance between the full locking protrusion and the side wall can be reduced and the breakage of the side wall by the full locking protrusion can be prevented in the process of moving the retainer to the full locking position.

DETAILED DESCRIPTION

Figure 2:
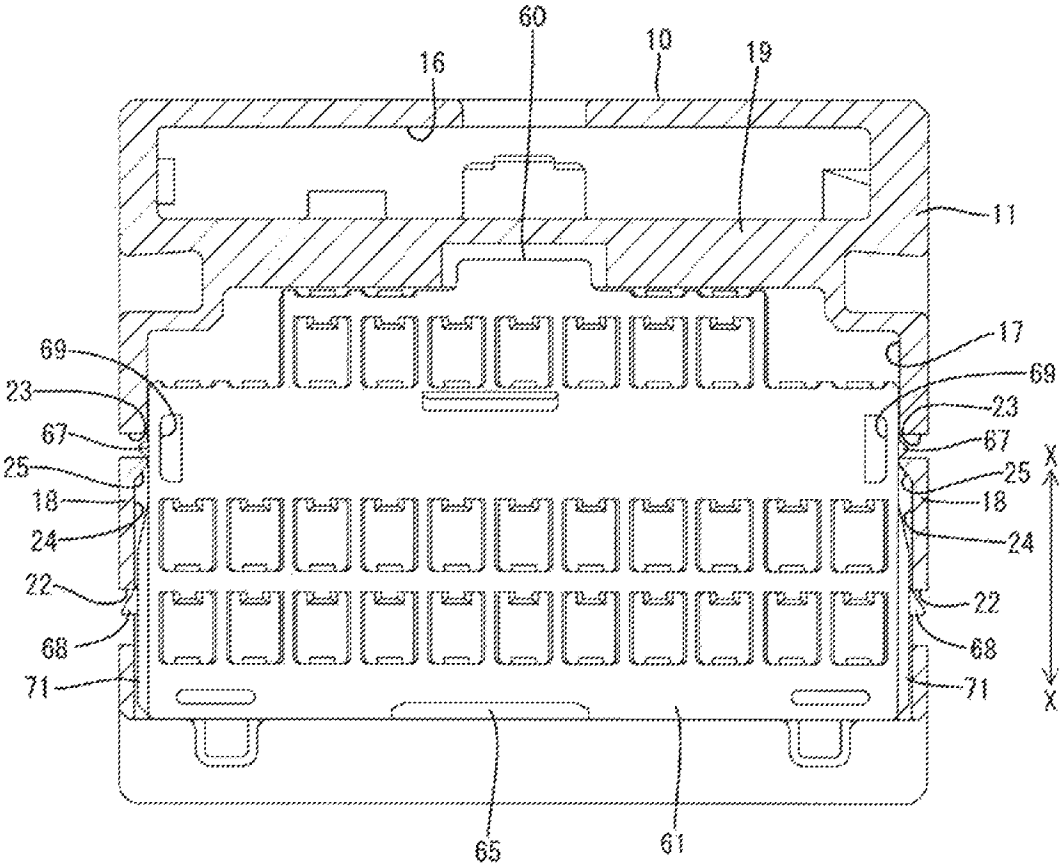
FIG. 2 is a front view in section of the housing in which the retainer is held at a full locking position.
Figure 3:
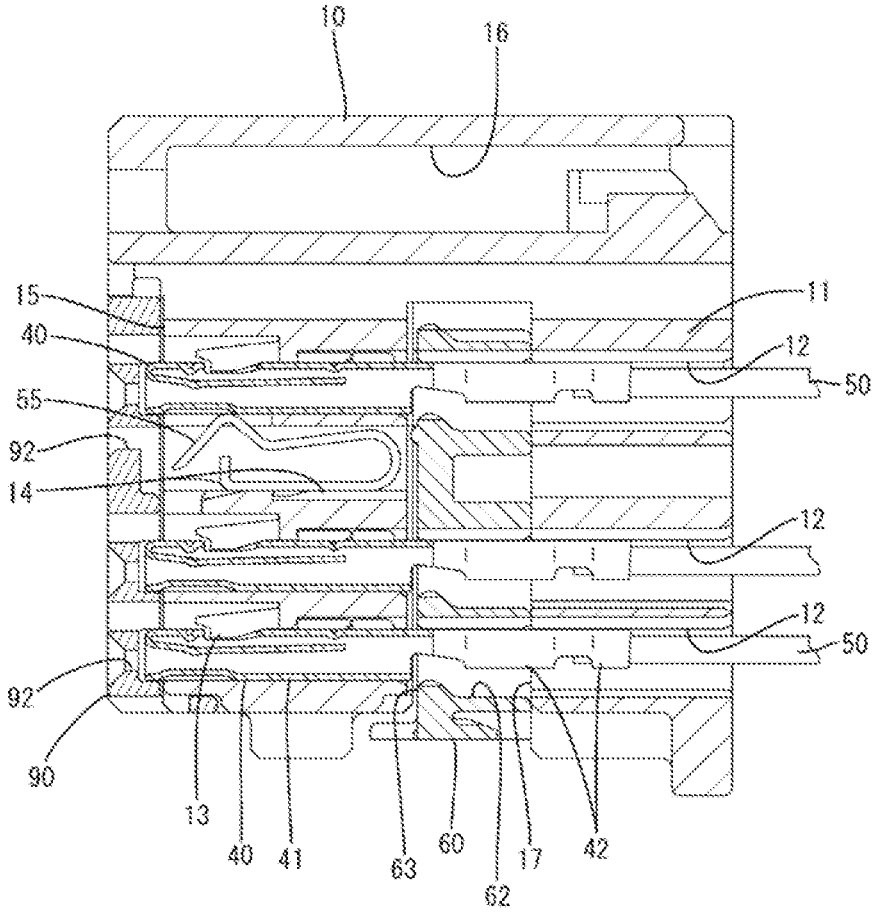
FIG. 3 is a side view in section of the housing in which the retainer is held at the partial locking position.
Figure 4:
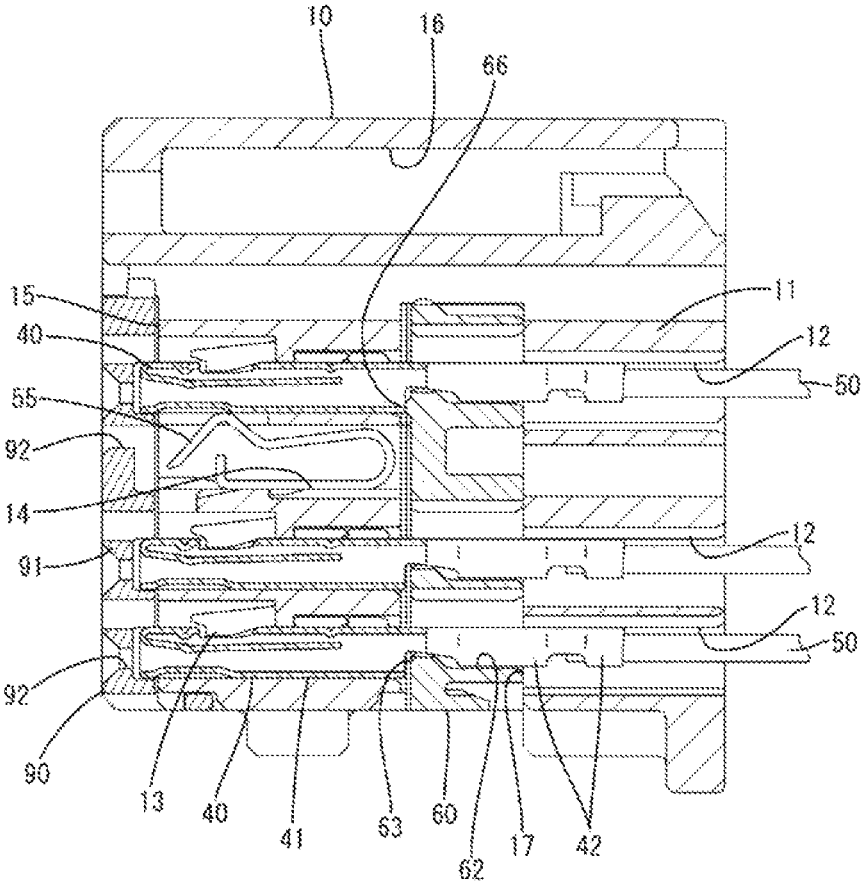
FIG. 4 is a side view in section of the housing in which the retainer is held at the full locking position.

A connector of this embodiment includes, as shown in FIGS. 3 and 4, a housing 10, terminal fittings 40 to be accommodated into the housing 10 and a retainer 60 to be mounted into the housing 10. Note that, in the following description, a left side of FIGS. 3 to 6, 9 and 10 is referred to as a front side concerning a front-rear direction. Further, a vertical direction is based on FIGS. 1 to 6, 8 and 10 and a lateral direction is based on FIGS. 1, 2, 7, 8 and 11.

The housing 10 is made of synthetic resin and connectable to an unillustrated mating housing from front and includes a housing body 11 substantially in the form of a rectangular block. As shown in FIGS. 3 and 4, a plurality of cavities 12 are provided to penetrate through the housing body 11 in the front-rear direction. A locking lance 13 cantilevered forward is provided at an inner wall of each cavity 12. The terminal fitting 40 is inserted into the cavity 12 from behind.

The terminal fitting 40 is made of an electrically conductive material and, as shown in FIGS. 3 and 4, formed to be long and narrow in the front-rear direction as a whole. The terminal fitting 40 includes a tubular connecting portion 41 in a front part and a barrel portion 42 in the form of an open barrel in a rear part. A male tab of an unillustrated mating terminal fitting mounted in the mounting housing is inserted into the connecting portion 41 for connection when the both housings are properly connected. The connecting portion 41 is locked by the locking lance 13. The barrel portion 42 is crimped and connected to an end part of a wire 50.

As shown in FIGS. 3 and 4, a terminal accommodation chamber 14 for accommodating a shorting terminal 55 is provided between the cavities 12 in an upper stage and the cavities 12 located therebelow in the housing body 11. Although not shown in detail, the shorting terminal 55 is resiliently held in contact with the terminal fittings 40 adjacent in the lateral direction in the cavities 12 in the upper stage to maintain the both terminal fittings 40 in a shorted state until the both housings are properly connected, and releases the shorted state of the both terminal fittings 40 by being separated from the both terminal fittings 40 when the both housings are properly connected.

As shown in FIGS. 3 and 4, a front member 90 separate from the housing body 11 is mounted on the housing body 11. The front member 90 is made of synthetic resin and includes a plate-like front wall 91 fittable into a recess 15 provided in the front surface of the housing body 11. The front wall 91 includes a plurality of tab insertion holes 92 allowing the passage of the mating tabs of the mating terminal fittings at positions corresponding to the respective cavities 12 and the terminal accommodation chamber 14. Note that a front end part of the connecting portion 41 is fit and inserted into a rear end part of the tab insertion hole 92.

As shown in FIGS. 1 to 4, a flat lever accommodation chamber 16 penetrating in the front-rear direction is provided in an upper end part of the housing body 11. An unillustrated lever is rotatably accommodated into the lever accommodation chamber 16.

Figure 1:
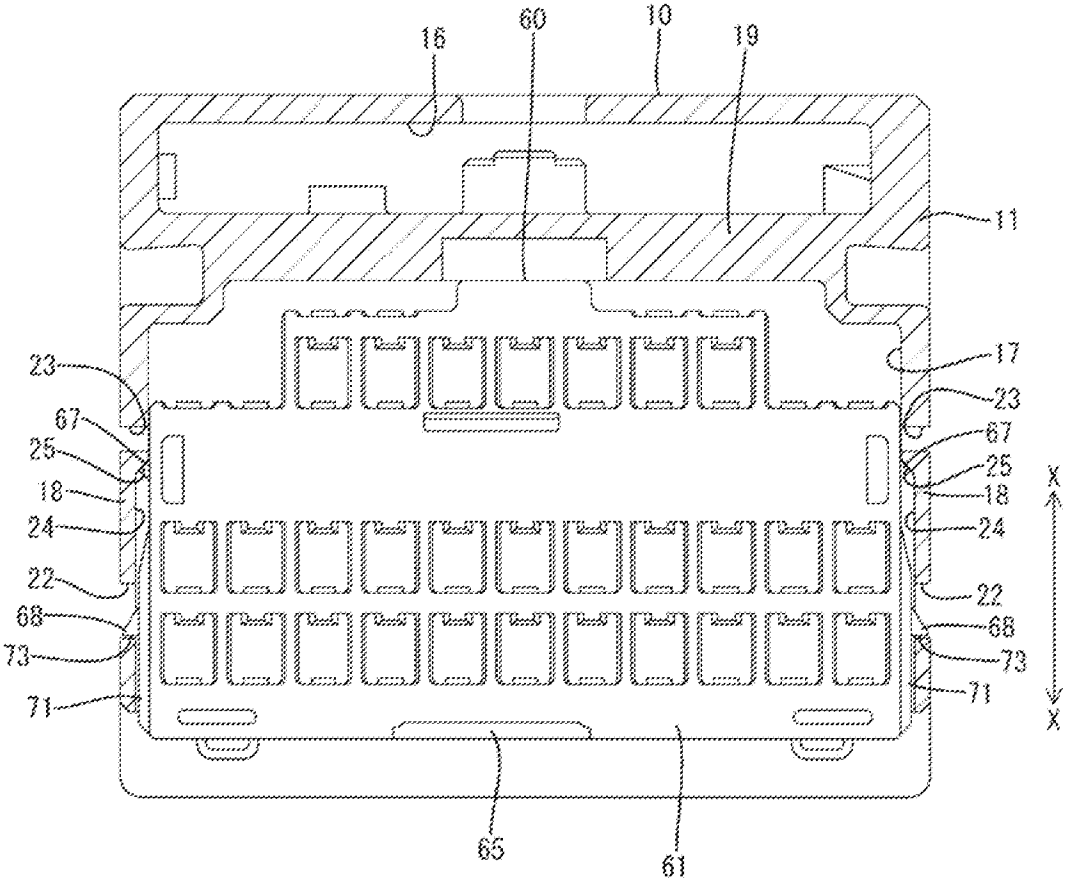
FIG. 1 is a front view in section of a housing, in which a retainer is held at a partial locking position, in a connector of an embodiment of the present invention.
Figure 11:
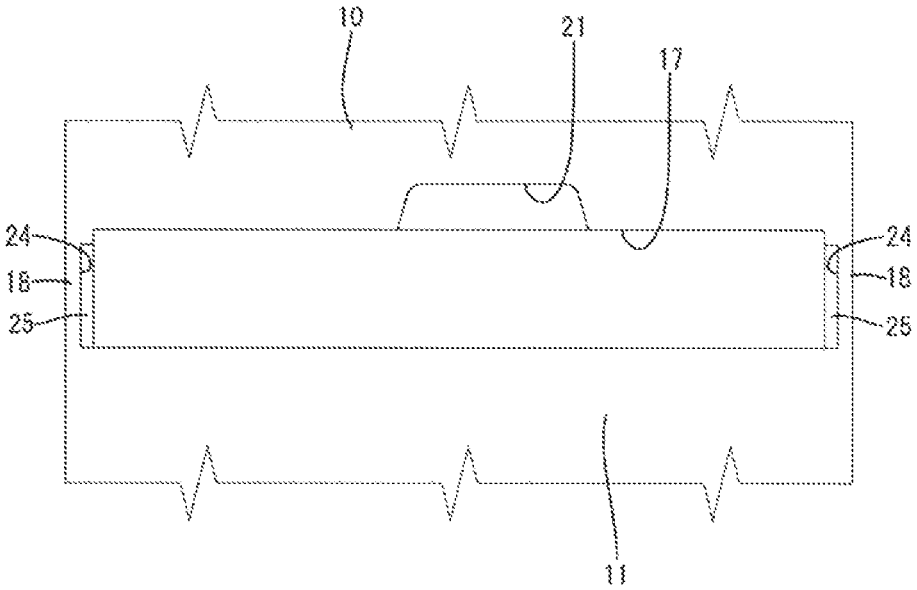
FIG. 11 is a bottom view of the housing.
Figure 12:
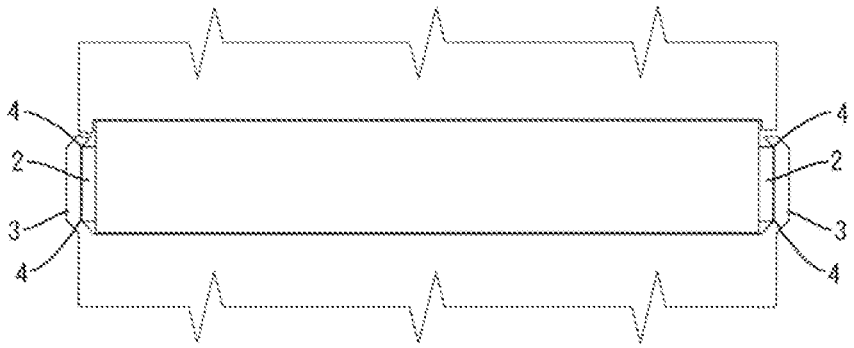
FIG. 12 is a view showing a problem residing in a prior art.

As shown in FIG. 11, a mounting hole 17 having a substantially rectangular shape long in the lateral direction is provided to be open in the lower surface of the housing body 11. The mounting hole 17 communicates with all the cavities 12 at a position behind the locking lances 13 and, as shown in FIGS. 1 and 2, has both left and right sides closed by a pair of side walls 18 and an upper side closed by an upper wall 19. The retainer 60 is inserted into the mounting hole 17 from below. The upper wall 19 is arranged along the lateral direction and functions as a wall for partitioning between the lever accommodation chamber 16 and the mounting hole 17.

Figure 7:
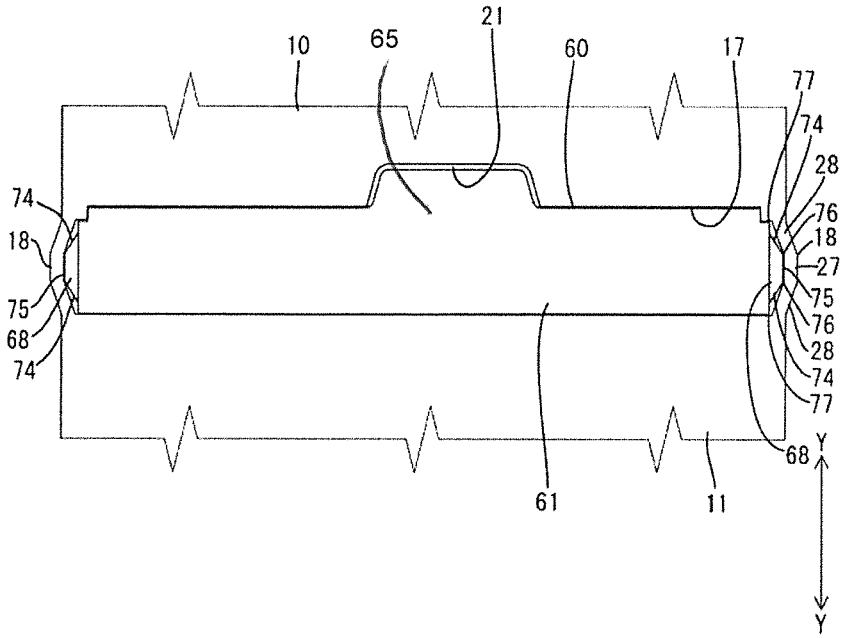
FIG. 7 is a bottom view of the housing having side walls deflected and deformed by lock protrusions in the process of moving the retainer toward the partial locking position.

The both side walls 18 are thinner than the upper wall 19 as a whole and deflectable and deformable in directions to protrude outward with parts coupled to front and rear areas across the mounting hole 17 in the housing body 11 as supporting points as shown in FIG. 7.

As shown in FIG. 11, a shallow fitting recess 21 is provided at a position in front of and communicating with the mounting hole 17 in the lower surface of the housing body 11. As shown in FIG. 7, a projecting piece 65 of the retainer 60 is fittable into the fitting recess 21.

Figure 5:
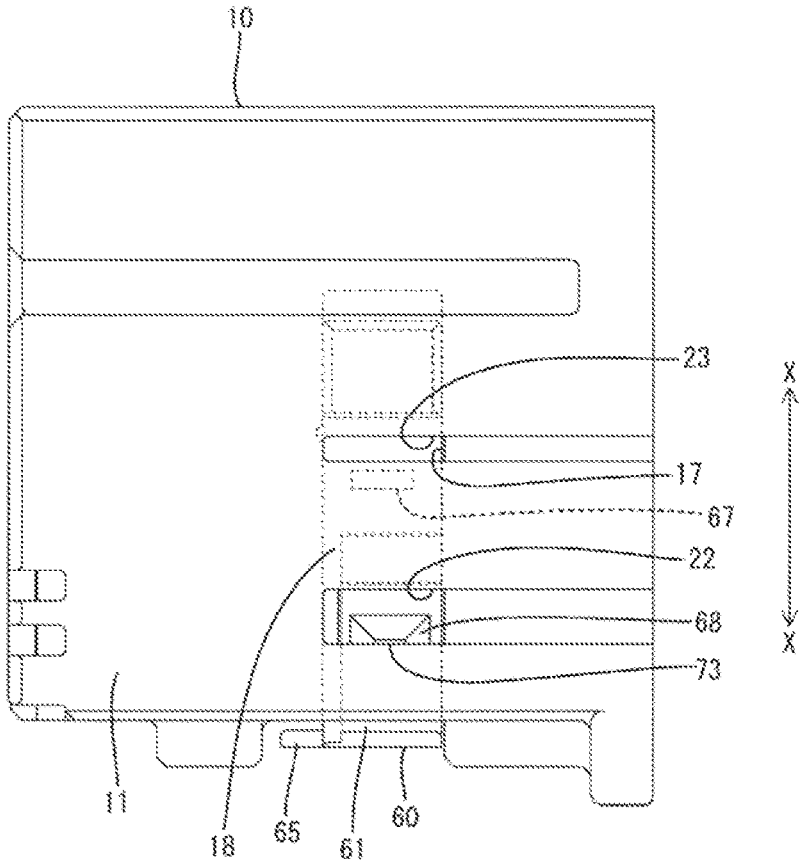
FIG. 5 is a side view of the housing in which the retainer is held at the partial locking position.
Figure 6:
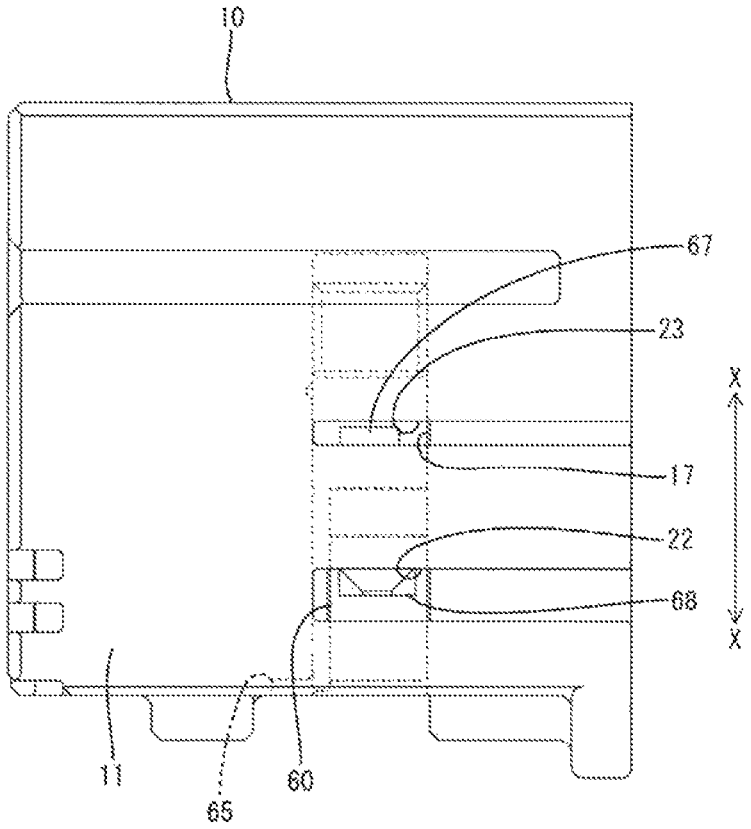
FIG. 6 is a side view of the housing in which the retainer is held at the full locking position.

As shown in FIGS. 5 and 6, lock receiving portions 22 extending in the front-rear direction are provided to be open in rear parts of the both side surfaces of the housing body 11 and full locking receiving portions 23 extending in the front-rear direction in parallel to the lock receiving portions 22 are provided to be open above the lock receiving portions 22. The lock receiving portions 22 and the full locking receiving portions 23 are both open in the rear end of the housing body 11 and, as shown in FIGS. 1 and 2, penetrate through the side walls 18 in a thickness direction (lateral direction).

As shown in FIGS. 5 and 6, a vertical opening width of the lock receiving portion 22 is larger than that of the full locking receiving portion 23. A later-described lock portion of the retainer 60 is insertable into the lock receiving portion 22 of the side wall 18 for locking as shown in FIG. 5, and a later-described full locking protrusion 67 of the retainer 60 is insertable into the full locking receiving portion 23 of the side wall 18 for locking as shown in FIG. 6.

As shown in FIGS. 1 and 2, an escaping groove 24 extending from a position below the full locking receiving portion 23 to the lower surface of the housing body 11 and communicating with the lock receiving portion 22 at an intermediate position is provided in the inner surface of the side wall 18. In the process of mounting the retainer 60 into the housing 10, the full locking protrusions 67 are inserted into the escaping grooves 24 and allowed to escape. The upper surface of the escaping groove 24 is formed into an upwardly inclined tapered surface 25. The full locking protrusion 67 is slidable on the tapered surface 25.

Figure 8:
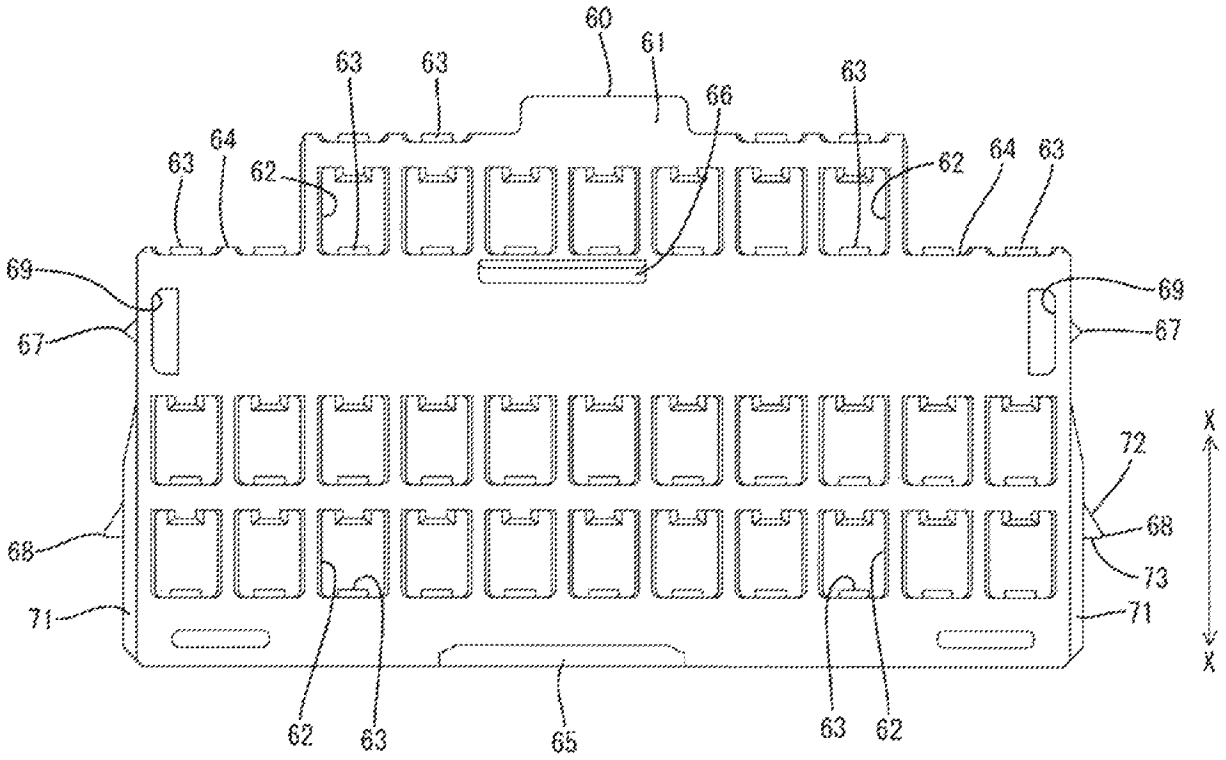
FIG. 8 is a front view of the retainer.
Figure 9:
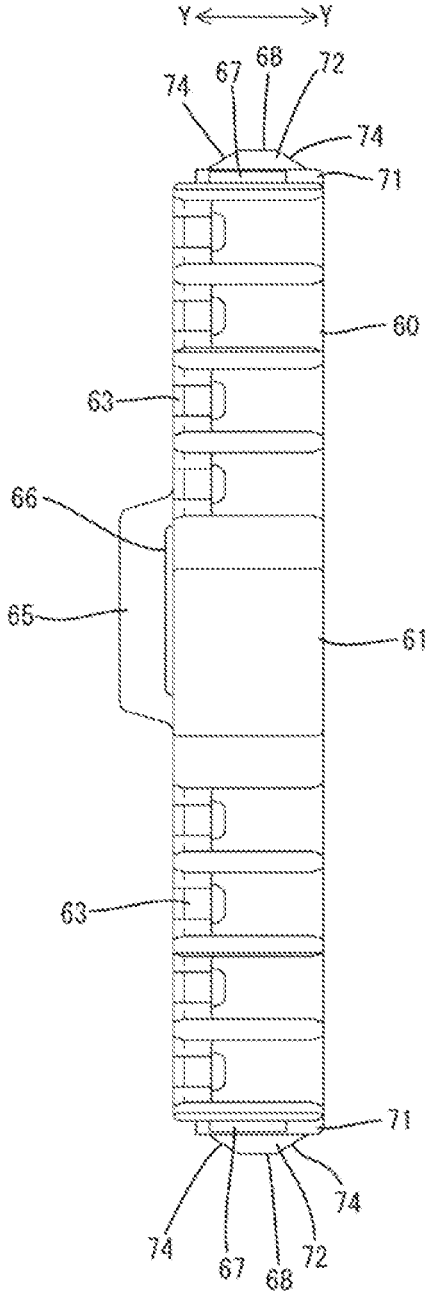
FIG. 9 is a plan view of the retainer.
Figure 10:
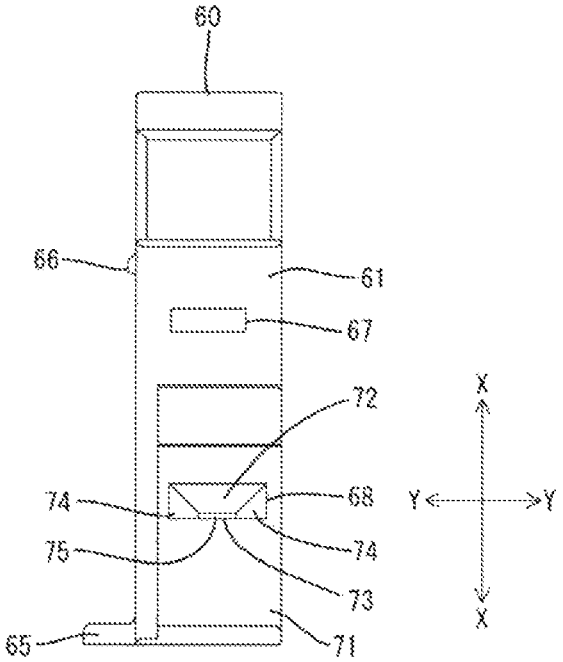
FIG. 10 is a side view of the retainer.

Next, the retainer 60 is described. The retainer 60 is made of synthetic resin and includes, as shown in FIGS. 8 to 10, a plate-like retainer body 61 somewhat thick in the front-rear direction and long in the lateral direction. The retainer body 61 of the retainer 60 is inserted into the mounting hole 17 from below and the retainer 60 is movable to a partial locking position (see FIGS. 1 and 3) where a lower end part of the retainer body 61 is arranged to project from the lower surface of the housing body 11 and a full locking position (see FIGS. 2 and 4) where the lower end of the retainer body 61 is arranged substantially at the same height as the lower surface of the housing body 11 by pushing and deeply inserting the retainer body 61 into the mounting hole 17 from the partial locking position.

The retainer body 61 is provided with a plurality of through holes 62 penetrating at positions communicating with the respective cavities 12 at the full locking position as shown in FIG. 8. Each through hole 62 has a substantially rectangular opening cross-section corresponding to a cross-sectional shape of the connecting portion 41 of the terminal fitting 40. A retaining portion 63 is provided to project on the lower edge of each through hole 62. The retaining portions 63 are also provided on shoulder portions 64 slightly recessed on both left and right end parts of the retainer body 61 and on an upper end part in a substantially laterally central part of the retainer body 61. The retainer 63 is arranged to be retracted downwardly of the corresponding cavity 12 from the cavity 12 at the partial locking position as shown in FIG. 3 and arranged to be lockable to the connecting portion 41 of the terminal fitting 40 by entering the corresponding cavity 12 at the full locking position as shown in FIG. 4.

As shown in FIGS. 8 and 9, the projecting piece 65 is provided in a substantially laterally central part of the lower end of the front surface of the retainer body 61. The projecting piece 65 is in the form of a thin plate extending along the lateral direction and fit and inserted into the fitting recess 21 of the housing body 11 at the full locking position. Further, a rattling preventing rib 66 is provided in a substantially laterally central part of an upper part of the front surface of the retainer body 61. The rattling preventing rib 66 extends in the lateral direction in parallel to the projecting piece 65. As shown in FIG. 4, the rattling preventing rib 66 has a function of preventing the rattling of the terminal fittings 40 in the front-rear direction by coming into contact with the terminal fittings 40 to be connected to the aforementioned shorting terminal 55 at the full locking position.

As shown in FIG. 8, the full locking protrusion 67 and a lock protrusion 68 are provided side by side in the vertical direction on each of the both side surfaces of the retainer body 61. In the process of inserting the retainer body 61 into the mounting hole 17, the lock protrusions 68 slide on the inner surfaces of the side walls 18, specifically on groove surfaces of the escaping grooves 24 of the side walls 18 and the side walls 18 are deflected and deformed to protrude outward. In the case of this embodiment, the vertical direction is an inserting direction of the retainer 60 into the mounting hole 17 and a sliding direction of the lock protrusions 68 on the side walls 18. Thus, in the following description, the vertical direction is referred to as a sliding direction X (see FIGS. 1, 2, 5, 6, 8 and 10), an upper side is referred to as a front side (leading side) in the sliding direction X and a lower side is referred to as a rear side in the sliding direction X if necessary. Further, the front-rear direction perpendicular to the sliding direction X is referred to as a sliding width direction Y (see FIGS. 7, 9 and 10).

As shown in FIG. 10, the full locking protrusion 67 is arranged above the lock protrusion 68 (on a front side in the inserting direction of the retainer 60 into the mounting hole 17) and in the form of a rib extending in the sliding width direction Y. As shown in FIG. 8, the upper surface of the full locking protrusion 67 is tapered downwardly toward a projecting end and the lower surface of the full locking protrusion 67 is tapered upwardly toward the projecting end. Slit holes 69 long and narrow in the sliding direction X are provided at inner positions facing the full locking protrusions 67 on both end parts of the retainer body 61.

As shown in FIGS. 8 and 9, flat table-like base portions 71 are provided on lower parts of the both side surfaces of the retainer body 61. As shown in FIGS. 1 and 2, the base portions 71 are fit and inserted into the escaping grooves 24 with the retainer 60 inserted in the mounting hole 17. A projecting dimension (projecting dimension from the side surface of the retainer body 61) of the base portion 71 is equal to or slightly smaller than that of the full locking protrusion 67.

The lock protrusion 68 projects from the outer surface of the base portion 71 and is one size larger than the full locking protrusion 67. As shown in FIG. 7, a dimension of the base of the lock protrusion 68 in the sliding width direction Y is set to be equal to or larger than half the opening dimension of the mounting hole 17 in the sliding width direction Y. Further, a projecting dimension of the lock protrusion 68 is larger than that of the full locking protrusion 67 and smaller than a depth of the lock receiving portion 22 (see FIG. 1).

As shown in FIG. 8, the upper surface of the lock protrusion 68 is formed into a guiding surface 72 tapered downwardly toward a projecting end. The lower surface of the lock protrusion 68 is formed into a substantially horizontal locking surface 73 along the lateral direction. In other words, the guiding surface 72 is formed by chamfering a tip corner part of the lock protrusion 68 in the sliding direction X in a tapered manner, and the locking surface 73 is shaped such that a rear end corner part of the lock protrusion 68 in the sliding direction X is at a right angle to the outer surface of the base portion 71.

Further, as shown in FIGS. 9 and 10, both front and rear surfaces (both end surfaces in the sliding width direction Y) of the lock protrusion 68 are formed into tapered inclined surfaces 74 inclined to approach each other toward the projecting end. In other words, the inclined surfaces 74 are shaped by chamfering both end corner parts of the lock protrusion 68 in the sliding width direction Y. An inclination angle of the inclined surface 74 with respect to the sliding width direction Y is a gentle inclination angle smaller than 45°. A dimension of the lock protrusion 68 in the sliding width direction Y is gradually reduced from the base toward the projecting end of the lock protrusion 68 by the both inclined surfaces 74. Further, as shown in FIG. 10, a projecting end surface 75 of the lock protrusion 68 is defined by the guiding surface 72, the locking surface 73 and the both inclined surfaces 74 and has a flat rectangular shape long in the sliding width direction Y in a side view.

Next, functions of the connector of this embodiment are described.

In assembling, the retainer 60 is inserted into the mounting hole 17 of the housing body 11 from below. When the insertion of the retainer 60 into the mounting hole 17 is started, the guiding surfaces 72 of the lock protrusions 68 slide on the inner surfaces of the side walls 18 and the side walls 18 are deflected and deformed to protrude outward. Further, in the process of inserting the retainer 60, the projecting end surfaces 75 of the lock protrusions 68 slide while pressing the inner surfaces of the side walls 18 and the side walls 18 are maximally deflected and deformed as shown in FIG. 7. At this time, central parts 27 of the side walls 18 in the sliding width direction Y are arranged in contact with the projecting end surfaces 75 of the lock protrusions 68. On the other hand, both end parts 28 of the side walls 18 in the sliding width direction Y are obliquely arranged between end edges 76 of the projecting end surfaces 75 of the side walls 18 and front and rear corner edges 77 of the retainer body 61 and arranged at a distance from the inclined surfaces 74 of the lock protrusions 68 without contacting the inclined surfaces 74. Thus, substantially no frictional resistance is generated between the both end parts 28 of the side walls 18 in the sliding width direction Y and the lock protrusions 68 and the side walls 18 are satisfactorily deflected and deformed within the range of resiliency limit thereof.

Thereafter, when the lock protrusions 68 reach positions corresponding to the lock receiving portions 22, the side walls 18 resiliently return and, as shown in FIGS. 1 and 5, the lock protrusions 68 are inserted into the lock receiving portions 22 and the locking surfaces 73 of the lock protrusions 68 are arranged to be able to come into contact with the lower ends of the lock receiving portions 22. Thus, downward separation of the retainer 60 from the housing body 11 is prevented. Further, the full locking protrusions 67 are arranged to be able to come into contact with the tapered surfaces 25 of the escaping grooves 24, whereby an upward movement of the retainer 60 is restricted. In this way, the retainer 60 is held at the partial locking position with vertical movements restricted. Note that, as shown in FIG. 1, the projecting end surfaces 75 of the lock protrusions 68 inserted into the lock receiving portions 22 are arranged at positions retracted from the outer surfaces of the side walls 18.

As shown in FIG. 3, when the retainer 60 is at the partial locking position, the terminal fittings 40 are inserted into the cavities 12 of the housing body 11 from behind and the properly inserted terminal fittings 40 are temporarily retained by the locking lances 13. Subsequently, the retainer 60 is moved to the full locking position. In the process of moving the retainer 60 to the full locking position, the full locking protrusions 67 slide on the tapered surfaces 25 of the escaping grooves 24 and are resiliently displaced inwardly while narrowing the slit holes 69. Further, in the process of moving the retainer 60 toward the full locking position, the lock protrusions 68 move upward in the lock receiving portions 22 and are kept in a state not in contact with the side walls 18.

When the retainer 60 reaches the full locking position, the slit holes 69 are restored to have an initial hole width and, as shown in FIGS. 2 and 6, the full locking protrusions 67 are inserted into the full locking receiving portions 23 and arranged to be lockable to the lower ends of the full locking receiving portions 23. Further, at the full locking position, the projecting piece 65 is inserted into the fitting recess 21 from below and arranged to be able to come into contact with the back surface of the fitting recess 21. In this way, the retainer 60 is held at the full locking position with vertical movements restricted. Furthermore, at the full locking position, each retaining portion 63 of the retainer 60 is inserted into the corresponding cavity 12 and arranged to be lockable to the connecting portion 41 of the terminal fitting 40 properly inserted into the cavity 12 as shown in FIG. 4, whereby the terminal fitting 40 is secondarily retained. Note that, as shown in FIG. 2, the lock protrusions 68 are arranged to be able to come into contact with the upper ends of the lock receiving portions 22 at the full locking position.

As described above, according to this embodiment, the both end corner parts of the lock protrusion 68 in the sliding width direction Y are chamfered into the inclined surfaces 74. Thus, as shown in FIG. 7, when the lock protrusions 68 slide while deflecting the side walls 18 in the mounting process of the retainer 60, the side walls 18 are not strongly pulled by the both end corner parts of the lock protrusions 68 in the sliding width direction Y and it can be prevented that the side walls 18 are deflected beyond the resiliency limit to be broken. Particularly, since the dimension of the base of the lock protrusion 68 in the sliding width direction Y is more than half the opening dimension of the mounting hole 17 in the sliding width direction Y in the case of this embodiment, the side wall 18 is easily broken by being pulled by the lock protrusion 68 and it provides a large advantage that the both end corner parts of the lock protrusion 68 in the sliding width direction Y are chamfered.

Further, since the tip corner part of the lock protrusion 68 in the sliding direction X is chamfered into the guiding surface 72, the side wall 18 is not strongly pulled by the tip corner part of the lock protrusion 68 in the sliding direction X and the damage of the side wall 18 can be more reliably prevented when the lock protrusion 68 slides while deflecting the side wall 18.

Further, since the projecting end of the lock protrusion 68 is arranged to be retracted from the outer surface of the side wall 18 with the lock protrusion 68 inserted in the lock receiving portion 22 as shown in FIG. 1, the interference of external matters with the projecting end of the lock protrusion 68 can be avoided.

Furthermore, since the full locking protrusion 67 is arranged above the lock protrusion 68 (before the lock protrusion 68 in the inserting direction of the retainer 60 into the mounting hole 17), a range in which the lock protrusion 68 slides on the side wall 18 can be suppressed to be small and the breakage of the side wall 18 can be even more reliably prevented. Further, since the projecting dimension of the full locking protrusion 67 is smaller than that of the lock protrusion 68, sliding resistance between the full locking protrusion 67 and the lock protrusion 68 can be reduced and a situation where the side wall 18 is broken by the full locking protrusion 67 can also be prevented.

Other embodiments are briefly described below.

The lock receiving portion may be configured as a bottomed recess open in the inner surface of the side wall instead of penetrating through the side wall.

The both end corner parts of the lock protrusion in the sliding width direction may be roundly chamfered.

The side wall may be less deflected without completely resiliently returning when the lock protrusion is inserted into the lock receiving portion.

The inclined surfaces of the lock protrusion may come into contact with the side wall in the mounting process of the retainer.

The lower surface of the lock protrusion may be at an acute angle to the projecting end surface to be reversely tapered.

LIST OF REFERENCE SIGNS

10 . . . housing
11 . . . housing body
12 . . . cavity
17 . . . mounting hole
18 . . . side wall
22 . . . lock receiving portion
23 . . . full locking receiving portion
40 . . . terminal fitting
60 . . . retainer
61 . . . retainer body
63 . . . retaining portion
67 . . . full locking protrusion
68 . . . lock protrusion
74 . . . inclined surface
X . . . sliding direction
Y . . . sliding width direction

The invention claimed is:

1. A connector, comprising:

a housing including a cavity into which a terminal fitting is insertable, a mounting hole communicating with the cavity, deflectable side walls for closing the mounting hole from opposite sides, and lock receiving portions provided on the side walls; and a retainer to be inserted into the mounting hole and including a retaining portion for locking the terminal fitting in the cavity and lock protrusions lockable to the housing by coming into contact with the lock receiving portions and provided at positions where the lock protrusions are slidable on the side walls on outer sides;

both end corner parts of the lock protrusion in a sliding width direction perpendicular to a sliding direction on the side wall being chamfered into inclined surfaces;

both end parts of the side wall in the sliding width direction being arranged at a distance from the inclined surfaces when the side wall is deflected and deformed by coming into contact with a projecting end surface of the lock protrusion.

2. A connector according to claim 1, wherein a tip corner part of the lock protrusion in the sliding direction on the side wall is chamfered.

3. A connector according to claim 2, wherein a dimension of a base of the lock protrusion in the sliding width direction is equal to or larger than half the opening dimension of the mounting hole in the sliding width direction.

4. A connector according to claim 3, wherein a projecting end of the lock protrusion is arranged to be retracted from an outer surface of the side wall with the lock protrusion inserted in the lock receiving portion.

5. A connector according to claim 4, wherein:

the retainer is movable, with respect to the housing, to a partial locking position where the retaining portion is retracted from the cavity and a full locking position where the retaining portion is inserted into the cavity to retain the terminal fitting, and provided with full locking protrusions separately from the lock protrusions;

the lock protrusions lock the lock receiving portions to restrict the separation of the retainer from the housing at the partial locking position, and the full locking protrusions lock full locking receiving portions of the housing to restrict a returning movement of the retainer to the partial locking position at the full locking position; and the full locking protrusion is arranged in front of the lock protrusion in the sliding direction of the lock protrusion on the side wall.

6. A connector according to claim 5, wherein a projecting dimension of the full locking protrusion is smaller than that of the lock protrusion.

7. A connector according to claim 1, wherein a dimension of a base of the lock protrusion in the sliding width direction is equal to or larger than half the opening dimension of the mounting hole in the sliding width direction.

8. A connector according to claim 1, wherein a projecting end of the lock protrusion is arranged to be retracted from an outer surface of the side wall with the lock protrusion inserted in the lock receiving portion.

9. A connector according to claim 1, wherein:

the retainer is movable, with respect to the housing, to a partial locking position where the retaining portion is retracted from the cavity and a full locking position where the retaining portion is inserted into the cavity to retain the terminal fitting, and provided with full locking protrusions separately from the lock protrusions;

the lock protrusions lock the lock receiving portions to restrict the separation of the retainer from the housing at the partial locking position, and the full locking protrusions lock full locking receiving portions of the housing to restrict a returning movement of the retainer to the partial locking position at the full locking position; and the full locking protrusion is arranged in front of the lock protrusion in the sliding direction of the lock protrusion on the side wall.

10. A connector according to claim 1, wherein a projecting dimension of the full locking protrusion is smaller than that of the lock protrusion.

* * * * *